US009570282B2

(12) United States Patent
Riaz et al.

(10) Patent No.: US 9,570,282 B2
(45) Date of Patent: Feb. 14, 2017

(54) IONIZATION WITHIN ION TRAP USING PHOTOIONIZATION AND ELECTRON IONIZATION

(71) Applicant: 1ST DETECT CORPORATION, Austin, TX (US)

(72) Inventors: Abrar Riaz, Wilmington, DE (US); David Rafferty, Webster, TX (US); James Wylde, Oak Leaf, TX (US)

(73) Assignee: 1ST DETECT CORPORATION, Austin, TX (US)

( * ) Notice: Subject to any disclaimer, the term of this patent is extended or adjusted under 35 U.S.C. 154(b) by 0 days.

(21) Appl. No.: 14/205,905

(22) Filed: Mar. 12, 2014

(65) Prior Publication Data

US 2014/0264010 A1 Sep. 18, 2014

Related U.S. Application Data

(60) Provisional application No. 61/801,471, filed on Mar. 15, 2013.

(51) Int. Cl.

| | |
|---|---|
| ***H01J 49/00*** | (2006.01) |
| ***H01J 49/10*** | (2006.01) |
| ***H01J 49/42*** | (2006.01) |
| ***H01J 49/14*** | (2006.01) |
| ***H01J 49/16*** | (2006.01) |

(52) U.S. Cl.

CPC ..... *H01J 49/107* (2013.01); *H01J 49/147* (2013.01); *H01J 49/162* (2013.01); *H01J 49/4215* (2013.01); *H01J 49/42* (2013.01)

(58) Field of Classification Search

USPC . 250/281, 282, 285, 423 R, 424, 427, 423 P

See application file for complete search history.

(56) References Cited

U.S. PATENT DOCUMENTS

| | | | |
|---|---|---|---|
| 3,626,181 | A | 12/1971 | Wernlund |
| 3,699,333 | A | 10/1972 | Cohen et al. |
| 3,933,432 | A | 1/1976 | Driscoll |
| 4,686,367 | A | 8/1987 | Louris et al. |
| 5,338,931 | A | 8/1994 | Spangler et al. |
| 5,808,299 | A | 9/1998 | Syage |

(Continued)

FOREIGN PATENT DOCUMENTS

JP 2005-093152 A 4/2005

OTHER PUBLICATIONS

Ann Westman-Brinkmalm et al., 2.1.9 Photoionization, in Mass Spectrometry—Instrumentation, Interpretation, and Applications, Jan. 1, 2009, p. 25.

(Continued)

*Primary Examiner* — Nicole Ippolito
*Assistant Examiner* — Hanway Chang
(74) *Attorney, Agent, or Firm* — Finnegan, Henderson, Farabow, Garrett & Dunner, LLP

(57) ABSTRACT

A mass spectrometer is disclosed. The mass spectrometer may include an ion trap configured to trap and analyze an ionized sample. A first aperture may be provided having a first diameter, and a second aperture may be provided having a second diameter. The first aperture may be configured to receive electrons for the purpose of ionizing sample ions within the ion trap. The second aperture may be configured to receive photons for the purpose of ionizing sample ions within the ion trap.

23 Claims, 11 Drawing Sheets

(56) References Cited

U.S. PATENT DOCUMENTS

| | | | | |
|---|---|---|---|---|
| 5,968,837 | A * | 10/1999 | Doring et al. | 436/173 |
| 6,294,780 | B1 | 9/2001 | Wells et al. | |
| 6,545,268 | B1 | 4/2003 | Verentchikov et al. | |
| 7,075,070 | B2 | 7/2006 | Lee et al. | |
| 7,973,277 | B2 | 7/2011 | Rafferty | |
| 2002/0008198 | A1 | 1/2002 | Kasten et al. | |
| 2004/0065824 | A1 | 4/2004 | Bateman et al. | |
| 2005/0194530 | A1* | 9/2005 | Thakur | 250/288 |
| 2009/0294657 | A1* | 12/2009 | Rafferty | H01J 49/424 250/283 |
| 2010/0084549 | A1 | 4/2010 | Ermakov et al. | |
| 2010/0123075 | A1 | 5/2010 | Dantus et al. | |
| 2010/0213367 | A1* | 8/2010 | Miller | 250/282 |
| 2011/0240840 | A1 | 10/2011 | Holmquist et al. | |
| 2012/0235032 | A1 | 9/2012 | Goebel et al. | |
| 2013/0193318 | A1* | 8/2013 | Land et al. | 250/282 |

OTHER PUBLICATIONS

Ji et al., A Segmented Ring, Cylindrical Ion Trap Source for Time-of-Flight Mass Spectrometry, Journal of the American Society for Mass Spectrometry, vol. 7, No. 10, Oct. 1, 1996, 9 pages.

Invitation to Pay Additional Fees and, where Applicable, Protest Fee under PCT Article 17(3)(a) and Rule 40.1 and 40.2(e) with Partial International Search Results in corresponding International Application No. PCT/US2014/021193 dated Sep. 24, 2014, 9 pages.

PCT International Search Report and Written Opinion in corresponding International Application No. PCT/US2014/021193 dated Nov. 17, 2014, 28 pages.

* cited by examiner

Plasma Light Source
Circuit 1

IONIZATION WITHIN ION TRAP USING PHOTOIONIZATION AND ELECTRON IONIZATION

RELATED APPLICATIONS

This application claims the benefit of U.S. Provisional Application No. 61/801,471, filed Mar. 15, 2013, which is herein incorporated by reference in its entirety.

FIELD OF THE DISCLOSURE

The present disclosure is directed to ionization of a sample and, more particularly, ionization of a sample within an ion trap using photoionization and electron ionization.

BACKGROUND OF THE DISCLOSURE

Mass spectrometers are instruments used to analyze the mass and abundance of various chemical components in a sample. Mass spectrometers work by ionizing the molecules of a chemical sample, separating the resulting ions according to their mass-charge ratios (m/z), and then measuring the number of ions at each m/z value. The resulting spectrum reveals the relative amounts of the various chemical components in the sample.

One type of mass analyzer used for mass spectrometry is called a quadrupole ion trap. Quadrupole ion traps take several forms, including three-dimensional ion traps, linear ion traps, and cylindrical ion traps. The operation in all cases, however, remains essentially the same. Direct current (DC) and time-varying radio frequency (RF) electric signals are applied to the electrodes to create electric fields within the ion trap. These fields trap ions within the central volume of the ion trap. Then, by manipulating the amplitude and/or frequency of the electric fields, ions are selectively ejected from the ion trap in accordance with their m/z. A detector records the number of ejected ions at each rink as they arrive. Regardless of the particular technology of mass spectrometer used, before sample molecules can be analyzed they must be ionized by one of various methods.

Electron ionization (EI) is one common method for generating sample ions. In EI, electrons are typically produced through a process called thermionic emission from a filement. Thermionic emission occurs when the kinetic energy of a charge carrier, in this case electrons, overcomes the work function of the conductor. In a vacuum chamber of a gas analyzer, where there is little gas or air to conduct heat from or react with a filament, a current through the filament quickly heats it until it emits electrons. The electrons are accelerated, usually with a set of electron optics, towards the sample, which may be contained within a mass analyzer (e.g., an ion trap). As the electrons travel through the gaseous sample, the electrons interact with, fragment, and ionize molecules in the sample. The charged particles can then be transported and analyzed using additional electric fields.

EI uses relatively energetic electrons with energies of around 70 electron volts to ionize sample molecules, and as such can sometimes cause weaker molecules to fragment into smaller ions. For this reason energetic electrons are sometimes referred to as a "hard" ionization source. Fragmentation can be beneficial in cases where one wishes to learn more about the parent ion by analyzing the fragment or "daughter" ions. In cases where fragmentation is not desired (e.g., it is desirable to know the mass of the parent ion), a softer ionization technique may be appropriate.

One such soft ionization technique is photoionization (PI). In PI, a light source emits photons, generally in the ultraviolet wavelength range, to provide sufficient energy to eject electrons from molecules in the chemical sample, thereby ionizing them. The photons in PI have lower energy than the electrons in EI, typically 5-10 electron volts as opposed to the 70 electron volts typical of EI. As such, PI generally allows sample compounds to remain intact. Broadly speaking, PI can be accomplished by two different techniques: single-photon ionization, and multi-photon ionization. Single-photon PI occurs when the PI source produces photons that individually have sufficient energy to ionize molecules. This usually corresponds to about 10.6 electron volts, or 110-130 nm wavelength. In multi-photon PI, the photons have less energy, perhaps only 5 electron volts, or 240-260 nm wavelength, and therefore multiple photon-molecule interactions are required to ionize the molecule.

Single-photon PI generally requires a source such as a plasma lamp in the ultraviolet range. Traditional ultraviolet light sources are generally large compared to the dimensions of an ion trap, and may require the source to be located away from the trapping region. As a result, ions must be created outside of the ion trap and transported into the ion trap via the use of electric fields or fluid flow. However, creating ions outside of the ion trap may result in reduced sensitivity of the mass spectrometer, and the electron optics required to transport the ions may add additional complexity to the instrument. Also, some architectures used for mass analyzers that lend themselves to miniaturization, for example ion traps, may not be effective at efficiently trapping ions generated from an external source. In addition, the extra ionization chamber requires more space and larger vacuum pumps to evacuate, making it potentially unsuitable for applications where size and power consumption are an issue.

Laser diodes are small enough to provide an ultraviolet light source directly into an ion trap; however, they are limited to a wavelength of 248 nm, which corresponds to about 5 electron volts. This energy is insufficient for single-photon PI. Multi-photon PI is possible, however, with appropriate pulsing of laser diodes.

Embodiments of the disclosure described herein may overcome at least some of the disadvantages described above.

SUMMARY OF THE EMBODIMENTS

The present disclosure is directed to a mass spectrometer including an ion trap, which includes a first aperture, a center electrode or electrodes, and a second aperture. The on trap may be configured to trap and analyze an ionized sample. The first aperture may have a first diameter, and may be configured to receive electrons for the purpose of ionizing sample ions within the ion trap. The second aperture may have a second diameter, and may be configured to receive photons for the purpose of ionizing sample ions within the ion trap. The spacing between the electrodes may also be configured to receive either electrons or photons to ionize samples within the trap.

The present disclosure is directed to a method of ionizing a sample within an ion trap. The method may include directing electrons into an ion trap and fragmenting the sample with the electrons within the ion trap. Additionally, the method may include directing photons into the ion trap at a different time from the electrons. The photons may be provided as a series of pulses with a total energy sufficient to ionize the sample.

BRIEF DESCRIPTION OF THE DRAWINGS

The drawings are not necessarily to scale or exhaustive. Instead, emphasis is generally placed upon illustrating the principles of the inventions described herein. The accompanying drawings, which are incorporated in and constitute a part of this specification, illustrate several embodiments consistent with the disclosure and together with the description, serve to explain the principles of the disclosure. In the drawings.

DETAILED DESCRIPTION OF THE EMBODIMENTS

Reference will now be made in detail to the embodiments of the present disclosure described below and illustrated in the accompanying drawings. Wherever possible, the same reference numbers will be used throughout the drawings to refer to same or like parts.

Figure 1A:
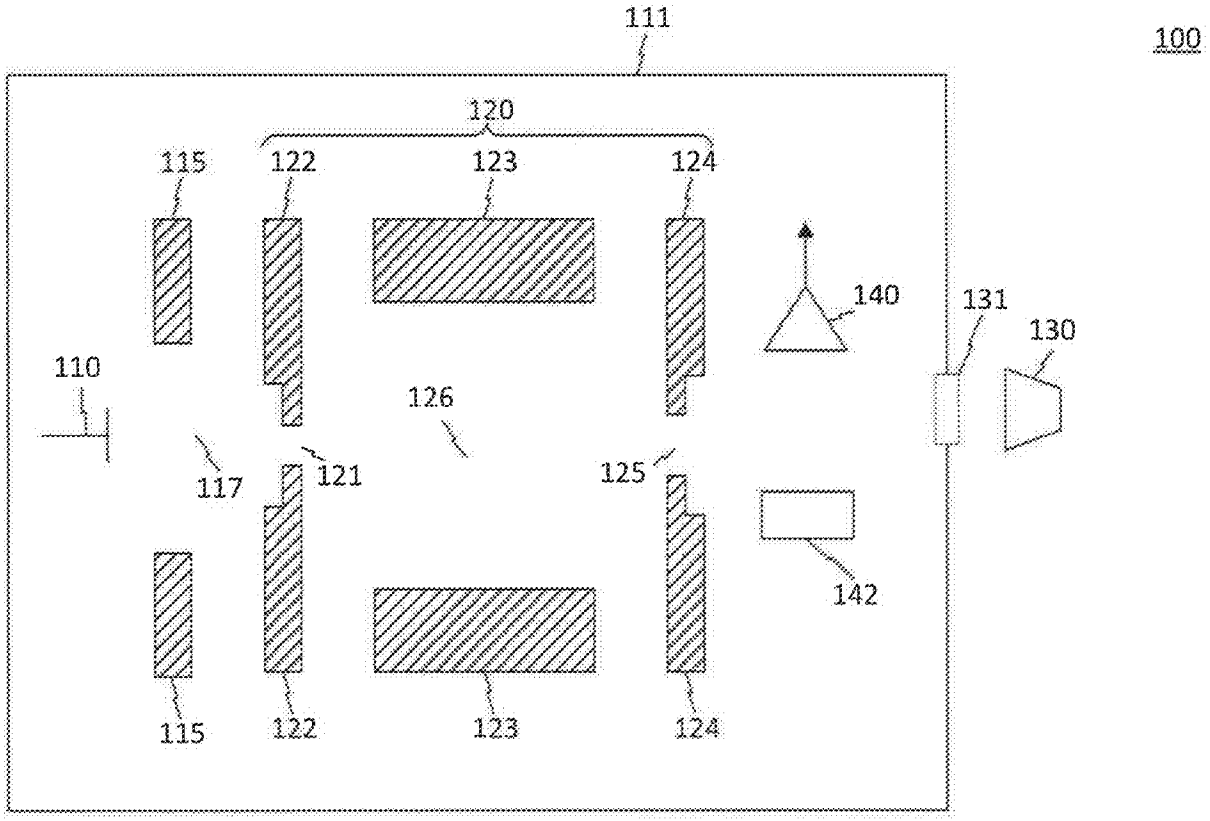
FIG. 1A shows a cross-sectional view of a mass spectrometer consistent with the disclosed embodiments.
Figure 1B:
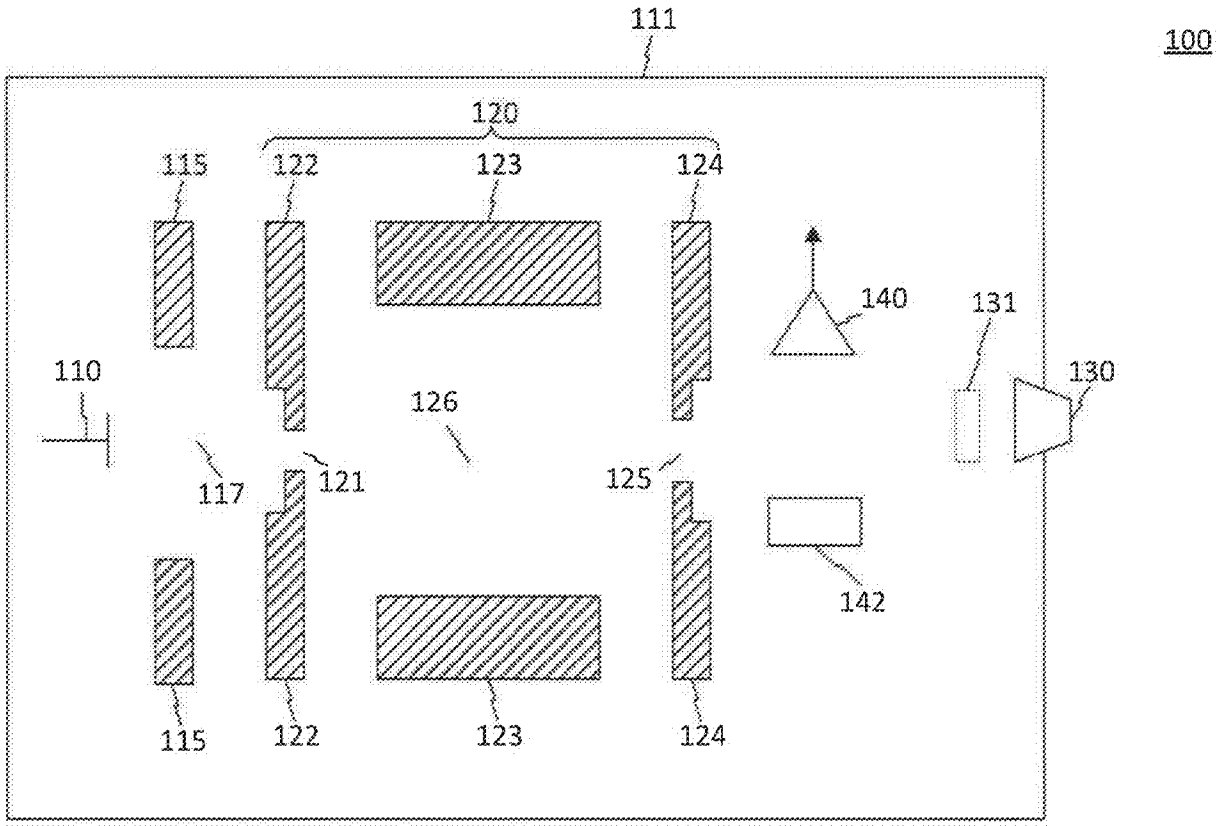
FIG. 1B shows another cross-sectional view of a mass spectrometer consistent with the disclosed embodiments.

Embodiments consistent with the present disclosure relate to a mass spectrometer configured to ionize a sample within an ion trap. The ionization may be accomplished through electron ionization (EI) or photoionization (PI). A coating may be provided on the ion trap to prevent unwanted electron emission during PI. Additionally, the ion trap may reduce electron burn or for other reasons known to those skilled in the art by providing end caps with different sized apertures. Several methods for ionizing the sample with EI and PI are disclosed in greater detail below. As shown in FIG. 1A, components of mass spectrometer 100 may include an electron source 110, ion trap 120, and ion detector 140 housed within a chamber 111. A lens or window 131 may be positioned in a side wall of chamber 111, and a photon source 130 may be positioned external of chamber 111. Lens 131 and photon source 130 may be in axial alignment and configured for photons to pass from photon source 130, through lens 131 and into chamber 111. Lens 131 may be configured to collimate or focus a photon beam from photon source 130. Lens 131 may be a ball, sphere, or a converging/plano convex lens. Lens 131 may comprise a material having a sufficient transmission spectrum, for example, magnesium fluoride or lithium fluoride. Magnesium fluoride may have approximately 80 percent transmission with wavelengths from about 2 μm to about 50 μm. Lithium fluoride may have approximately 95 percent transmission with wavelengths from about 2 μm to about 50 μm. In other embodiments, lens 131 may comprise a window in a metal electrode, and may be configured to prevent ion bombardment within ion trap 120. As shown in FIG. 1B, in alternate embodiments, photon source 130 may extend through a side wall of chamber 111, and lens 131 may be positioned within chamber 131.

Chamber 111 may be any suitable, substantially airtight container, and may be coupled to a vacuum path via one or more ports (not shown) so as to create a low pressure (e.g., vacuum) environment for chemical analysis. In operation, chamber 111 may be configured to receive a sample and convey the sample to ion trap 120 through one or more inlets (not shown). Electron source 110 may be configured to produce electrons and contain optics (not shown) to direct them into an ion trap 120. Additionally or alternatively, photon source 130 may produce pulses of photons and direct the pulses into ion trap 120. The sample may be ionized within ion trap 120 with either the electrons through EI, or photons through PI, and ion trap 120 may produce an alternating electric field to trap the ionized molecules. Ion detector 140 may receive the molecules ejected from ion trap, and may measure the number of ions at each mass-charge ratio (m/z).

Electron source 110 may include a filament configured to produce and direct electrons into ion trap 120. In one embodiment, electron source 110 may be heated with a current sufficient to emit electrons from a surface of electron source 110. The electrons may flow within an electric field from electron source 110, through an electron lens 115 and to ion trap 120. The electric field may focus the electrons into an electron beam as they travel from electron source 110 and through an aperture 117 of lens 115. The electron beam may enter ion trap 120 and ionize the sample molecules. A differential voltage may be established between the filament and lens 115 to accelerate the electrons into ion trap 120. In certain embodiments, changes in voltage applied to lens 115 may influence the amount of electrons directed into ion trap 120, and therefore the amount of molecules ionized within ion trap 120. A voltage difference may accelerate electrons sufficiently to ionize the sample. An increase in voltage may increase the number of electrons directed into ion trap 120, and a decrease in voltage may decrease the number of electrons directed into ion trap 120. It is recognized that other embodiments of the electron optics may be contemplated here that provide a sufficient number of electrons at a sufficient energy to ionize the sample in trap 120.

PI source 130 may include a light source configured to direct high intensity ultraviolet photons to the sample molecules within ion trap 120. In one embodiment, the photons may contact the sample molecules as the sample molecules enter ion trap 120. The photons may have sufficient energy to raise the energy level of one or more of the electrons contained within the sample molecules sufficiently to remove one or more of the electrons from a valence shell and thus ionize the molecules without fragmenting the molecules. For example, the photons may raise the energy level of the sample molecules to at least the ionization energy of the molecules. Photo source 130 may provide pulsed energy, as described in greater detail below, to raise the energy level of the molecules.

Ion trap 120 may include one or more electrodes. In one embodiment, ion trap 120 may have three electrodes including a ring electrode 123, a first end cap 122, and a second end cap 124. First end cap 122 may form a first aperture 121, and second end cap 124 may form a second aperture 125. Ring electrode 123 may be disposed between first and second end caps 122, 124. It is contemplated that ring electrode 123 may have any suitable shape, size, and/or configuration. In one embodiment, ring electrode 123 comprises a cylindrical shape forming a trap volume 126. In the embodiment of FIG. 1, ion trap 120 includes one trap volume 126, however, it is further contemplated that ion trap 120 may include a plurality of openings providing a plurality of different trap volumes 126. Additionally, ring electrode 123 may include any suitable conductive material, including, but not limited to, copper, silver, gold, platinum, iridium, platinum-iridium, platinum-gold, conductive polymers, stainless steel, etc. Alternately ring electrode may be split into 2 electrodes so that photons may be injected from the radial direction into the trap.

First and second apertures 121, 125 may each be formed in a substantially center portion of first or second end cap 122, 124 and axially aligned with trap volume 126. In some embodiments, first and second apertures 121, 125 may each comprise substantially circular cross-sections. As shown in FIG. 1, second aperture 125 may include a larger diameter than first aperture 121. For example, second aperture 125 may be approximately twice as large as first aperture 121. In one embodiment, second aperture 125 may have a diameter of approximately 0.0252 in. and first aperture 121 may have a diameter of approximately 0.0126 in. However, in another embodiment, second aperture may have a diameter of approximately 0.0500 in. and first aperture may have a diameter of approximately 0.0126 in.

Trap volume 126 of ring electrode 123 may include a coating configured to reduce and/or prevent electrons that may emit from ion trap 120 during a PI period or phase. The coating may surround a surface of trap volume 126. The coating may include a higher work function than the photons emitted from photon source 130, and may prevent the photons from liberating electrons from the surface of trap volume 126. In one embodiment, the coating may have a work function of about 11 eV, and the photons from photon source 130 may have a work function of about 10 eV. The coating may include a conductive or semiconductive material. For example, the coating may include a crystalline thin film with enhanced surface chemistry to prevent electron emission. In other embodiments the coating may include an insulated mask over the conductive material to prevent exposure to the ultraviolet light.

Ion trap 120 may be sufficient to trap and ionize molecules within trap volume 126. During an ionization period (i.e., a period when sample molecules are ionized via EI or PI in ion trap 120), ion trap 120 may generate time-varying electric fields to trap the ions within trap volume 126. For example, DC and RF fields may be applied to ring electrode 123 and produce an electric field sufficient to trap the molecules within trap volume 126. In some embodiments, DC and RF fields may also be applied to end caps 122, 124.

Mass spectrometer 100 may alter the DC and RF fields to eject the ionized molecules from ion trap 120. The ions may be ejected based on their m/z and into ion detector 140, which may be configured with a deflector or dynode 142. For example, a progressive increase in the strength of the electric fields may allow lighter ions to be ejected from ion trap 120 followed by heavier ions. As shown in FIG. 1, the ions may be ejected from second aperture 125 and into ion detector 140.

Ion detector 140 may be configured to capture the ions ejected from ion trap 120 and separate them for detection. Ion detector 140 may include a high negative voltage sufficient to attract the ejected ions, for example a voltage of approximately −2,000 V. In the embodiment of FIG. 1, ion detector 140 may be positioned on a side of ion trap 120 that is opposite of electron source 110. In this embodiment, ion detector 140 may be positioned on a same side of ion trap 120 as photon source 130. In the embodiment of FIG. 1, ion detector 140 is offset axially from electron source 110, trap volume 126, and first and second apertures 121, 125.

As shown in FIG. 1, ion detector 140 may be coupled with a conversion dynode 142 to accept ions of one polarity and emit particles of the opposite polarity, thus allowing the ions to be directed into ion detector 140. Ions ejected from ion trap 120 may have a positive or negative polarity. Conversion dynode 142 may have a negative or positive potential, depending on the polarity of the ions. In a first mode, positive ions are accelerated toward a negative conversion dynode 142. Conversely, in a second mode, negative ions are accelerated toward a positive conversion dynode 142. The ions may strike the surface of conversion dynode 142 and may emit electrons. Ion detector 140 may attract the electrons and convert them into an electric current. Additionally, ion detector 140 may record the charge and/or current produced when the photons pass an electrode array (not shown). The charge and/or current may correspond to the abundance of the particular ion. In other embodiments, ions are directed directly to detector 140 by an electric potential between the ion trap and the detector.

In operation, energy may be supplied to electron source 110 to release electrons into ion trap 120 via a focused electron beam. The electrons may be directed through first aperture 121 and into trap volume 126, where the electrons may ionize sample molecules by EI. The diameter of second aperture 125 may be enlarged relative to the diameter of first aperture 121 to prevent electrons from accumulating along a surface of second end cap 124. For example, second aperture 125 may allow electrons ejected into opening 120 to avoid contacting a surface of second end cap 124.

In a traditional mass spectrometer, electrons emitted from an electron source may not impact a sample, and instead the electrons may move across the ion trap and contact a second end cap in an area directly surrounding an aperture. Therefore, the electrons may hit the surface of the aperture before impacting neutral species within the trap to form ions. These electron collisions may induce a degradation of the surface around the aperture in such traditional systems. This may result in inaccurate detection of the ions within a sample, for example by creating field distortions. However, the enlarged diameter of second aperture 125 in the present disclosure may allow the electrons to avoid contact with second aperture 125 when emitted into trap volume 126. The electrons may then properly ionize a sample within ion trap 120.

The ionized sample may then be ejected from ion trap 120 and into detector 140 for detection. As described above, conversion dynode 142 is configured to provide a means of providing ions of a polarity that will be directed to detector 140. The diameter of second aperture 125 may also reduce and/or prevent ions from accumulating along a surface of second end cap 124. For example, second aperture 125 may allow ions to be ejected from ion trap 120 without contacting a surface of second end cap 124.

Ions emitted from a traditional ion trap and towards an ion detector may hit a surface of the second end cap in the area directly surrounding the aperture. Over a period of time the material may accumulate along the surface of the second end cap. This accumulation may form a resistive film that can hold an electric charge, eventually resulting in inaccurate analysis of the sample due to electric field distortions. However, the enlarged diameter of second aperture 125 may allow the ions to avoid contact with second aperture 125 when ejected from trap volume 126 and into ion detector 140.

Alternatively, ion trap 120 may ionize the sample through PI. Photons may be ejected from photon source 130 and into ion trap 120. In one embodiment, source 130 is configured to provide photons emitted with an energy sufficient to ionize species within the ion trap 120 with a single photon impact. The photons may pass through lens 131 before entering ion trap 120. The coating on ion trap 120 may be sufficient to prevent unwanted electron emission from a surface of the ion trap during PI. Such electron emission may cause unwanted fragmentation of sample ions.

Figure 2A:
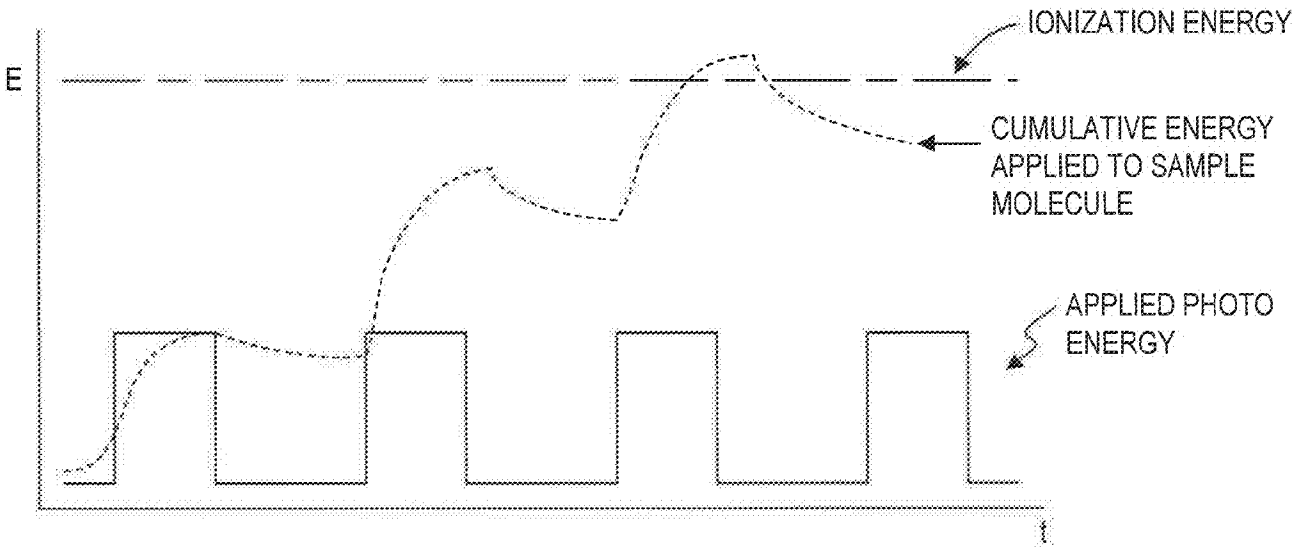
FIG. 2A shows pulse simulation of energy versus time for a photon source consistent with the disclosed embodiments.

In another embodiment, photon source 130 may provide the photons as a series of pulses, such that the pulses may collectively raise the ionization energy to an amount sufficient to ionize a sample molecule (FIG. 2A). For example, FIG. 2A illustrates that photon source 130 may apply pulses of photo energy and illustrates how the pulses of applied photo energy will cumulate with respect to the sample. That is, the energy applied, by the individual photons, to the sample will cumulate or increase as source 130 applies sequential pulses, such that the cumulative energy applied to the sample will eventually satisfy a predetermined ionization energy for ionizing the sample in the trap. Additionally, operating the photon source 130 in pulses may counteract the tendency of its output to decay over time. The photon pulses may have a wavelength corresponding to an energy higher than the ionization energy of the sample, for example a wavelength ranging from 240-320 nm. In other embodiments, the pulses may comprise a series of vacuum ultraviolet wavelength pulses ranging, for example, from 10-200 nm.

Photon source 130 may include a light source, wherein the light source may provide a series of photon pulses to a sample within ion trap 120. The light source may include, for example, a laser diode or a plasma lamp. Each consecutive pulse may further raise the energy level of the sample molecules higher than the preceding pulse, until each molecule has reached its ionization energy level (i.e., the level required to ionize the molecule). In one embodiment, each pulse may range from 2-50 ns in duration. The time between each pulse may range from 10-1,000 ns. Photon source 130 may also be pulsed such that ions are created only during the time interval in which the trap is configured to trap ions but switched off during the period when the trap is configured to eject ions.

Figure 2B:
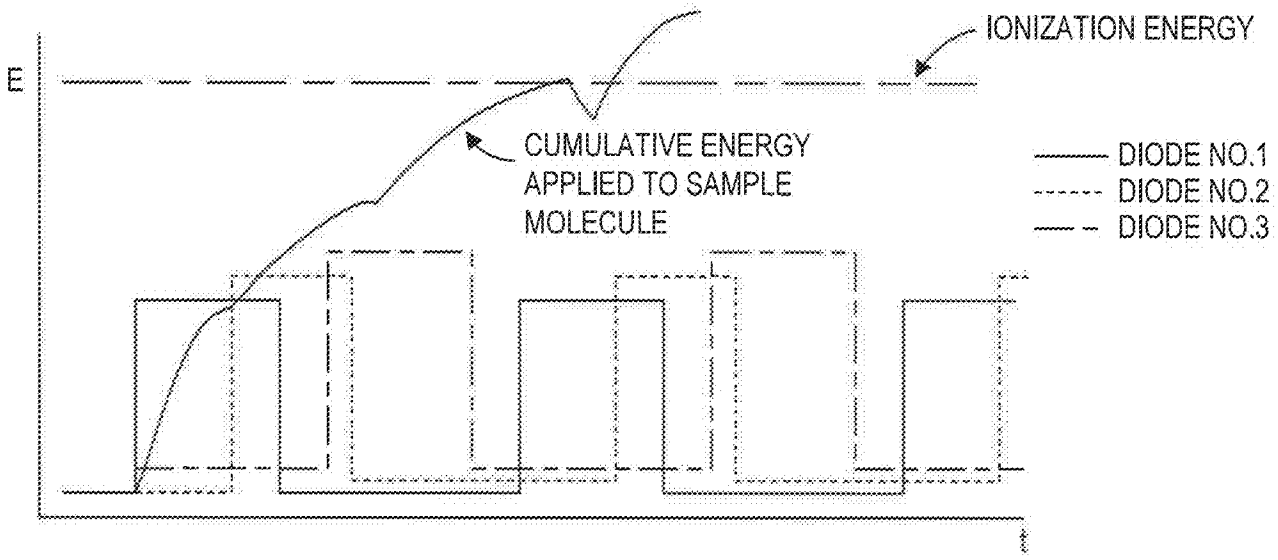
FIG. 2B shows another pulse simulation of energy versus time consistent with the disclosed embodiments.

As shown in FIG. 2B, photon source 130 may include one or more laser diodes configured to provide overlapping photon pulses. Therefore, a first diode may be configured to provide a first pulse sufficient to raise the energy level of a sample molecule. A second pulse may be provided after the first pulse has started but before the first pulse has completed. The second pulse may further raise the energy level of the sample molecule. In one embodiment, the overlapping pulses are provided by multiple diodes. For example, three diodes (e.g., diodes 1, 2, and 3 in FIG. 2B) may be used to raise the energy level of a sample molecule above its ionization energy. Each consecutive overlapping pulse may further raise the energy level of the sample molecule until it has reached this ionization energy level. The pulses may be of equal duration and amplitude, or of varying duration and amplitude. In one embodiment, the pulses may each have a duration ranging from 2-50 ns. The overlapping pulses may have ultraviolet or vacuum ultraviolet wavelength ranges.

Figure 3:
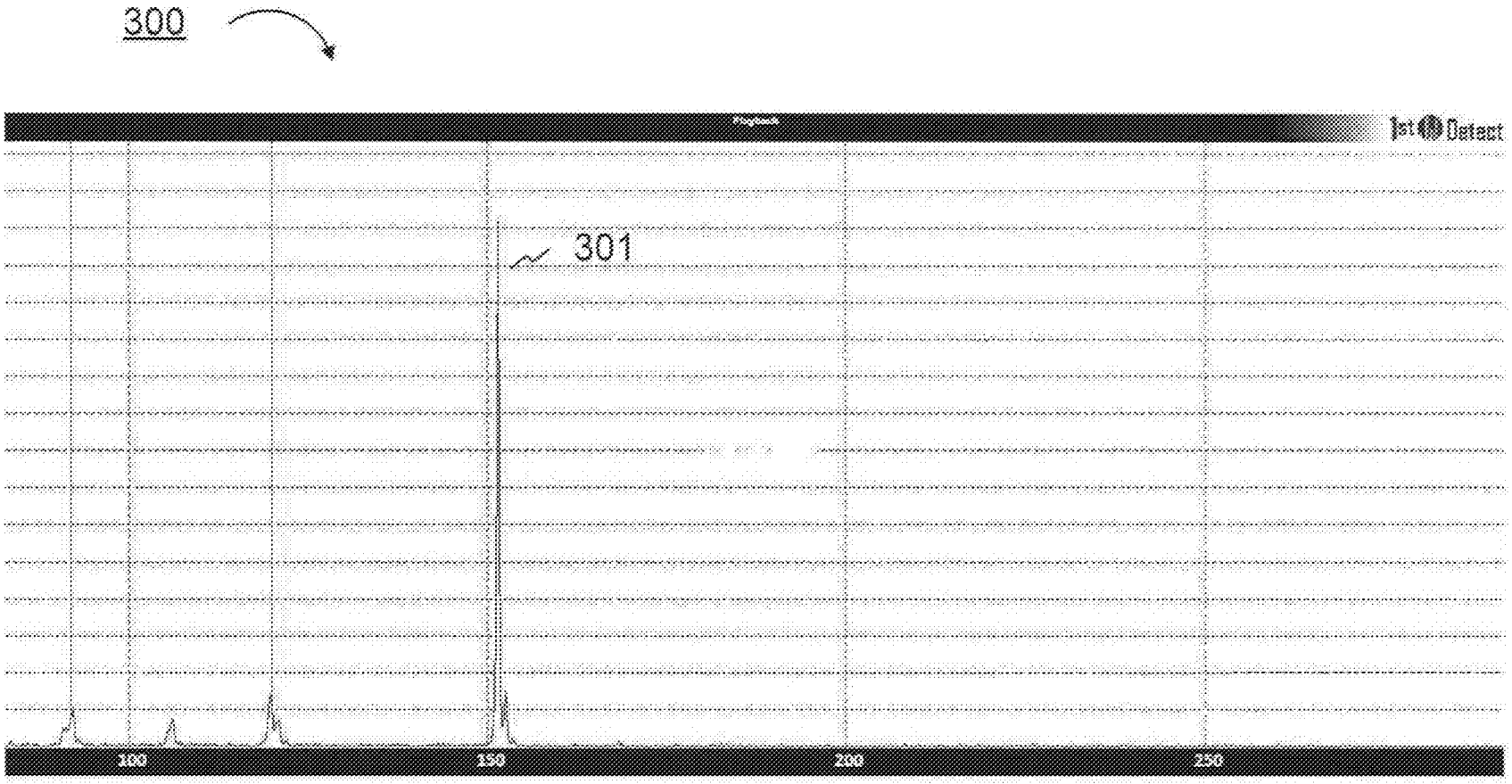
FIG. 3 shows a spectrum file of a sample consistent with disclosed embodiments.

FIG. 3 illustrates a spectrum file 300 of a methyl salicylate sample recorded using PI. In this example, photon source 130 included a plasma lamp. As shown in FIG. 3, the molecular peak of the sample 301, about 152 m/z, is preserved using the ionization methods disclosed.

Figure 4A:
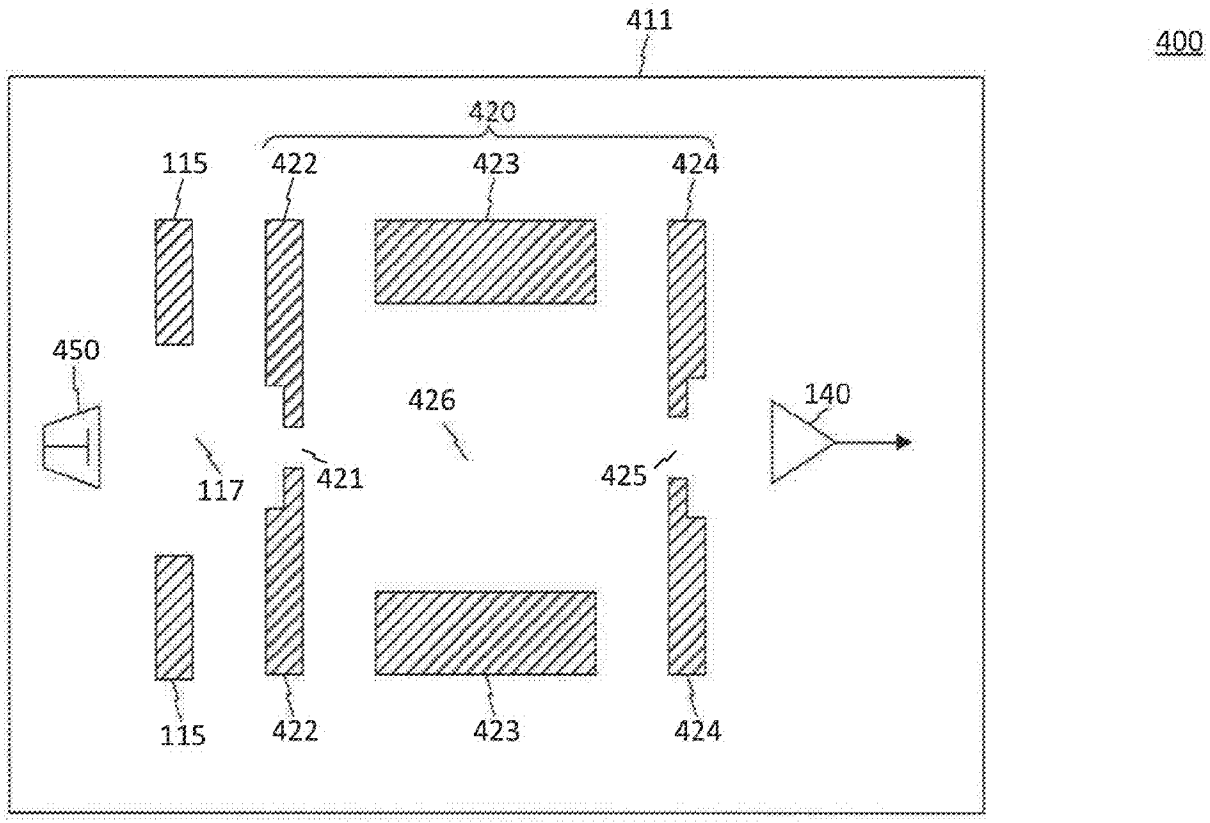
FIG. 4A shows a cross-sectional view of another embodiment of a mass a spectrometer consistent with the disclosed embodiments.
Figure 4B:
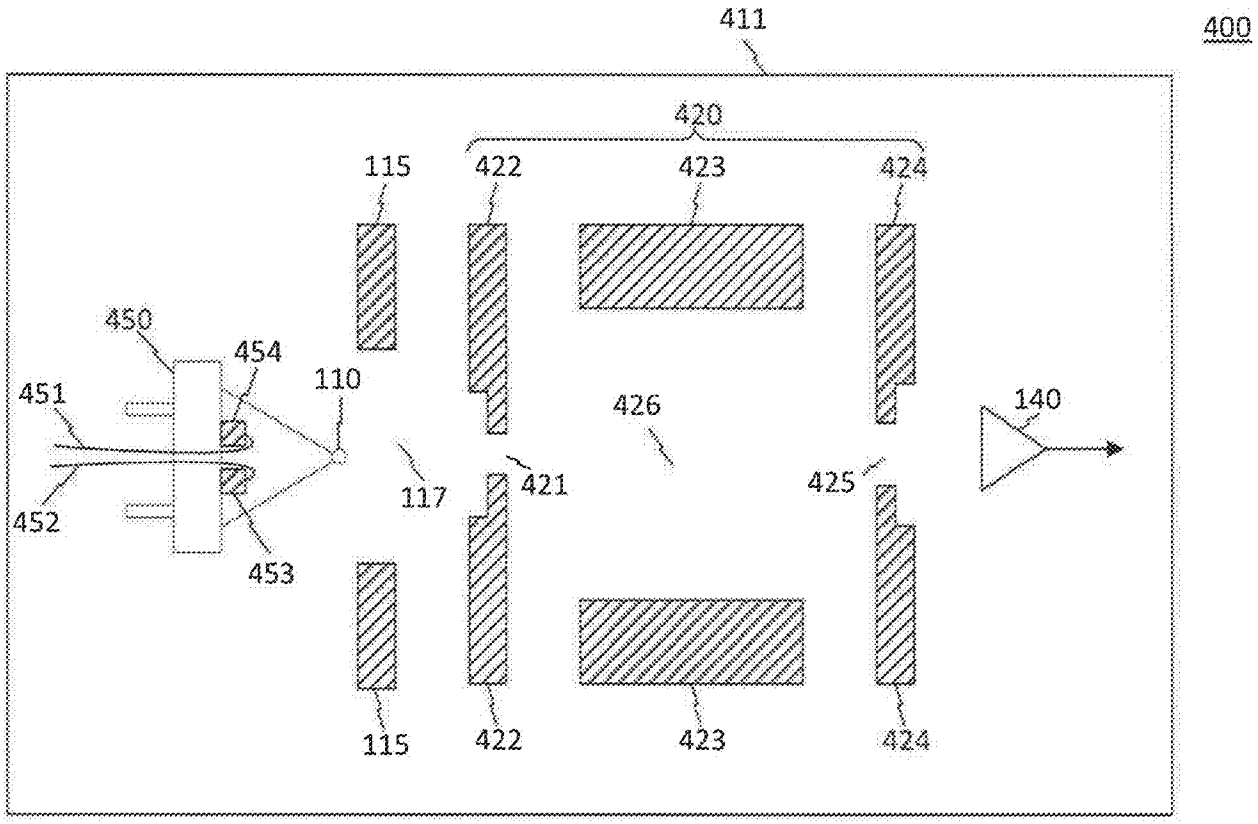
FIG. 4B shows a cross-sectional view of another embodiment of a spectrometer consistent with the disclosed embodiments.

FIG. 4 provides an alternate embodiment of mass spectrometer 400. In this embodiment, a source 450 is aligned with trap volume 426, first and second apertures 421, 425, and ion detector 140. Source 450 may provide a combined source for both electrons and photons, and may be configured to direct both electrons and photons into ion trap 420. The electrons and photons may travel through aperture 117 of lens 115 before entering trap volume 426. As discussed above, trap volume 126 may be formed by first end cap 422, second end cap 424, and ring electrode 423. The sample molecules within ion trap 420 may be ionized through the operations of both EI and PI, as previously discussed. In one embodiment, as shown in FIG. 4B, laser diodes 453 and 454 are mounted on the surface of electron source 110 and connected via electrical connections 451 and 452 to form a combined EI and PI source 450.

Figure 5:
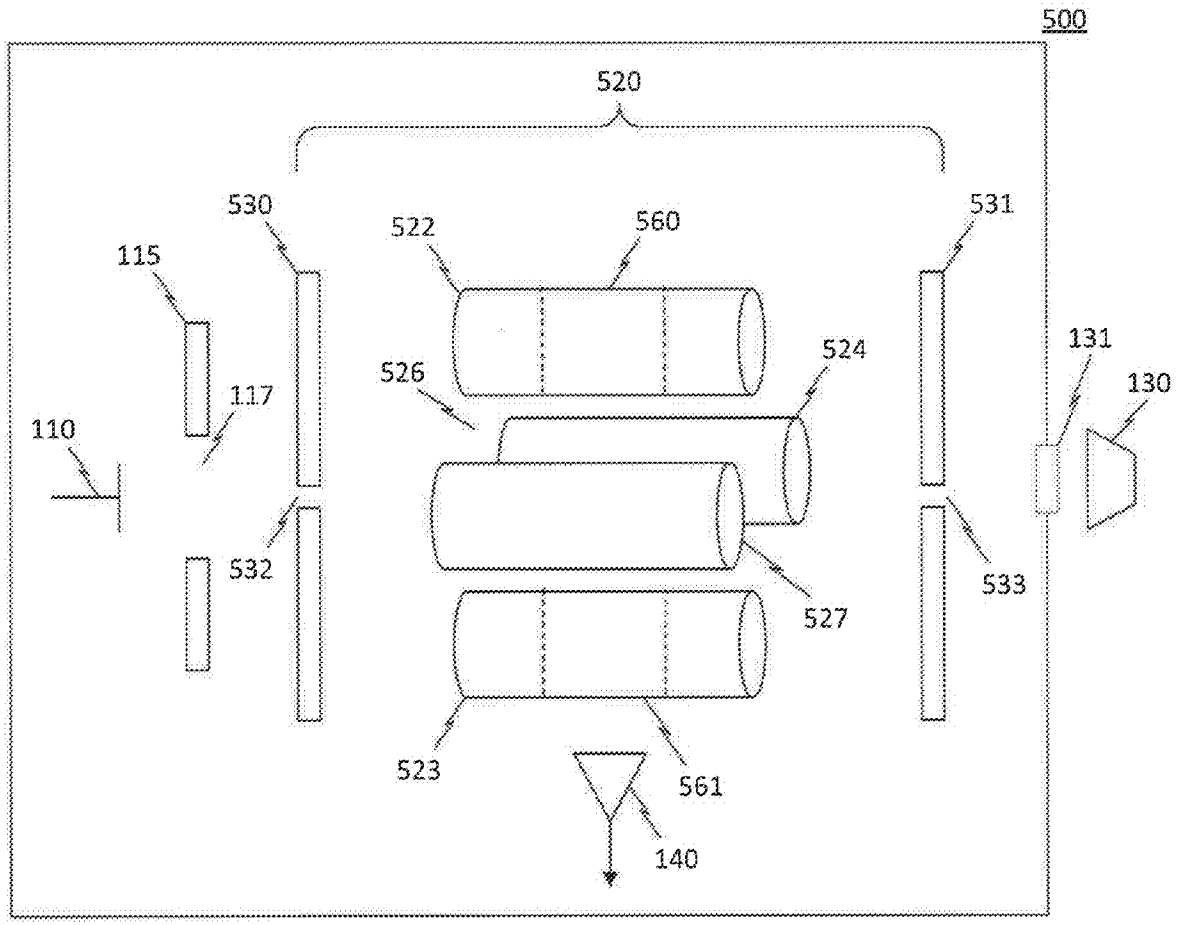
FIG. 5 shows a cross-sectional view of a linear ion trap consistent with the disclosed embodiments.

FIG. 5 provides an alternate embodiment of mass spectrometer 500 utilizing a linear ion trap 520 comprising a plurality of rods or ring electrodes. In the embodiment of FIG. 5, linear ion trap 520 comprises four electrodes 522, 523, 524, and 527. Electrodes 522 and 523 may have slots 560 and 561 for receiving sample molecules and/or ejecting ions for detection. Trap volume 526 may be formed within electrodes 522, 523, 524, and 527. Ions may be trapped within trapping volume 526 via application of DC and RF voltages to the four electrodes 522, 523, 524, and 527, and DC or RF voltages to end plates 530 and 531. Ions within trap volume 526 may then be ejected through slot 561 with the application of DC and RF voltages to electrodes 522, 523, 524, and 527 and end caps 530 and 531. Therefore, linear ion trap 520 may produce DC and RF fields to trap ions within, and eject ions from, trap volume 526.

End plates 530 and 531 may have apertures 532 and 533, respectively. Aperture 532 in end plate 530 may be configured to receive electrons via electron source 110. Aperture 533 in end plate 531 may be configured to receive photons via photon source 130. In other respects, the operations of EI and PI proceed as described previously, including the configuration of source region and ion detection region from embodiments described in FIG. 1 and FIG. 4A.

Figure 6:
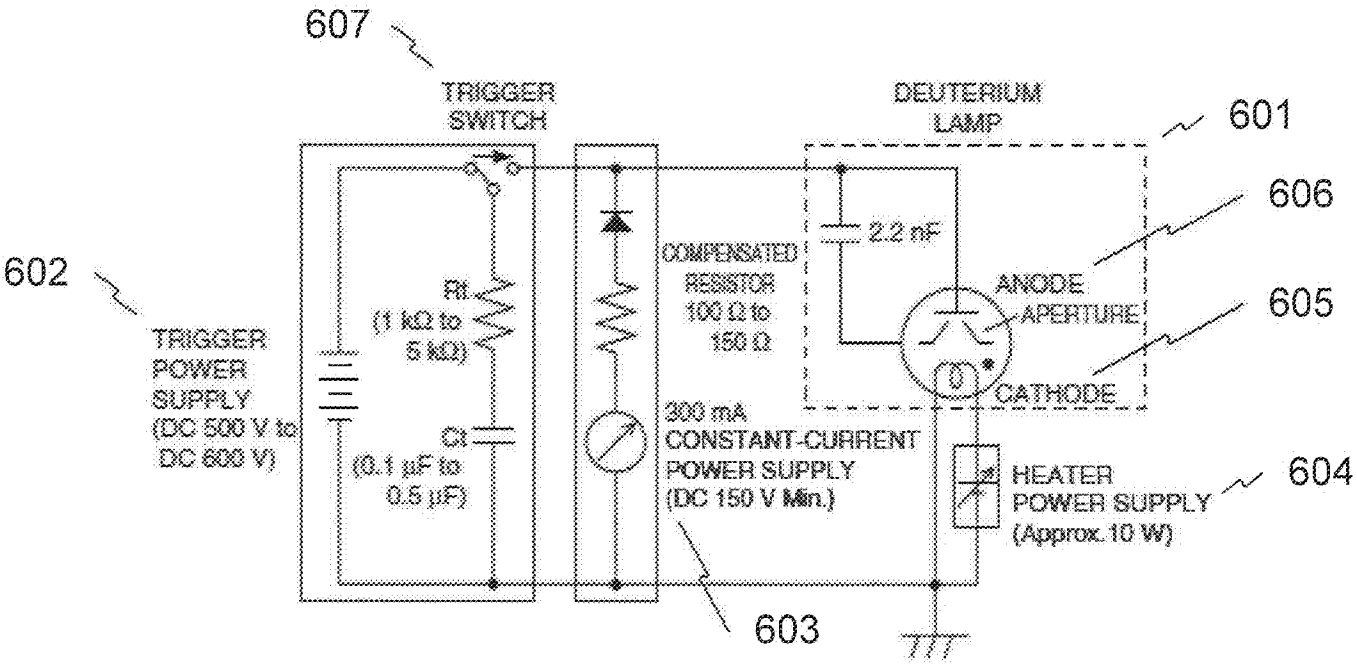
FIG. 6 shows an exemplary circuit for powering a plasma lamp consistent with disclosed embodiments.

FIG. 6 shows an exemplary circuit for powering a plasma lamp according to some disclosed embodiments. The lamp 601 can be of any rare gas type including krypton, xenon, or deuterium. Deuterium is used in a preferred embodiment. The circuit contains two different lamp power supplies for the two operational phases of the lamp, plus a third power supply for the filament. The first power supply is a trigger power supply 602. It provides the high voltage necessary to create an electron arc through the lamp when it is in gas phase. Once in plasma phase, the high voltage is no longer needed, and what is needed instead is a constant current supply to maintain the plasma arc. This constant current is supplied by the second power supply 603. The third power supply 604 serves to heat the filament to initiate thermionic emission of electrons from the filament during lamp operation.

The operation of the circuit is as follows. First, the third power supply 604 provides a current to the cathode filament 605, heating it sufficiently to cause thermionic emission of electrons. Second, the trigger power supply 602 is engaged to provide a high voltage of approximately 500-600 volts to the lamp anode 606. This voltage determines the energy of the electrons emitted from the cathode filament. When the energy of those electrons is sufficiently high, they will ionize the gas inside lamp 601 energize it into the plasma phase.

Once the lamp achieves the plasma state, the resistance between the lamp anode 606 and cathode 605 decreases and the current increases. At this point the high voltage of the trigger power supply 602 is no longer needed and it is disconnected via the trigger switch 607. The constant current power supply 603 takes over and maintains a current in the lamp 601 sufficient to maintain the plasma phase. In some embodiments, it may no longer be necessary to maintain a filament current through the lamp cathode 605 as the plasma arc will be sufficient to maintain the filament temperature. To turn the lamp off and end further photoionization once sufficient ionization has been achieved, a solid-state relay in series with lamp anode 606 (not shown) is opened to halt current through the lamp.

Figure 7:
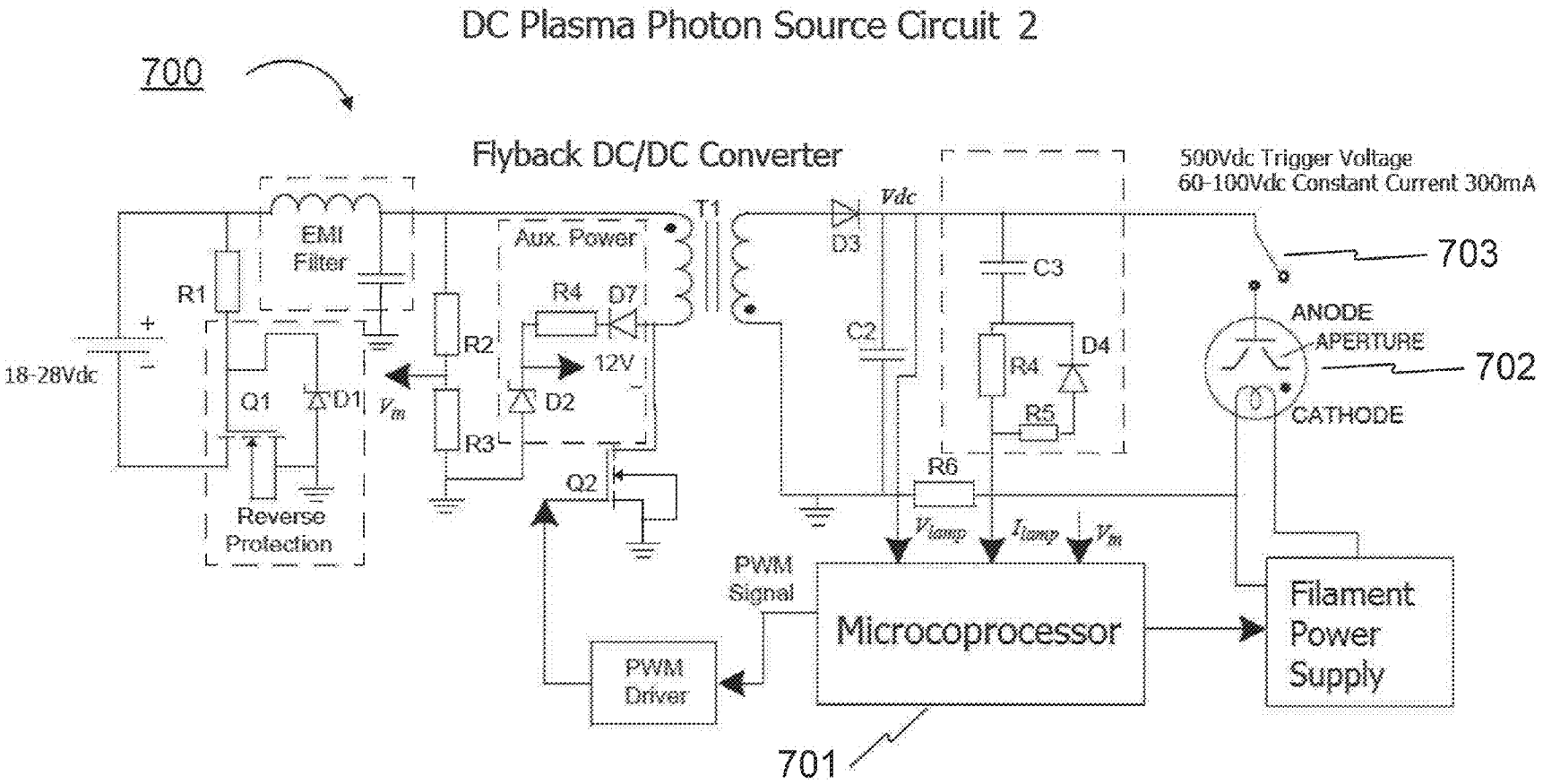
FIG. 7 shows another exemplary circuit for powering a plasma lamp consistent with disclosed embodiments.

FIG. 7 shows another exemplary circuit for powering a plasma lamp according to some disclosed embodiments. In this circuit, the trigger power supply and constant current power supplies are combined into a single intelligent power supply 700. This combined power supply can comprise any one of a number of boost topologies known in the art including a flyback, SEPIC, half-bridge, or full-bridge. The microprocessor 701 continuously reads the lamp voltage, current, and temperature ($V_{lamp}$, $I_{lamp}$, and $V_{in}$, respectively) and provides the necessary voltage to trigger the lamp 702, and then the necessary current to maintain operation.

This circuit has the additional advantages of being able to provide lamp state information to the user, and also to compensate for any variations in the lamp due to manufacturing, or degradation of the lamp over time. For example, the microprocessor can increase or decrease the trigger voltage and/or the constant current. It can also adjust switching synchronization with ionization time. The microprocessor may also render the solid-state relay 703 unnecessary because it can simply turn off the power supply to end the photoionization pulse. Finally, depending on the duration of the off time between photoionization pulses, the microprocessor may be able to dispense with the trigger voltage altogether as the lamp may still be in plasma phase.

Figure 8:
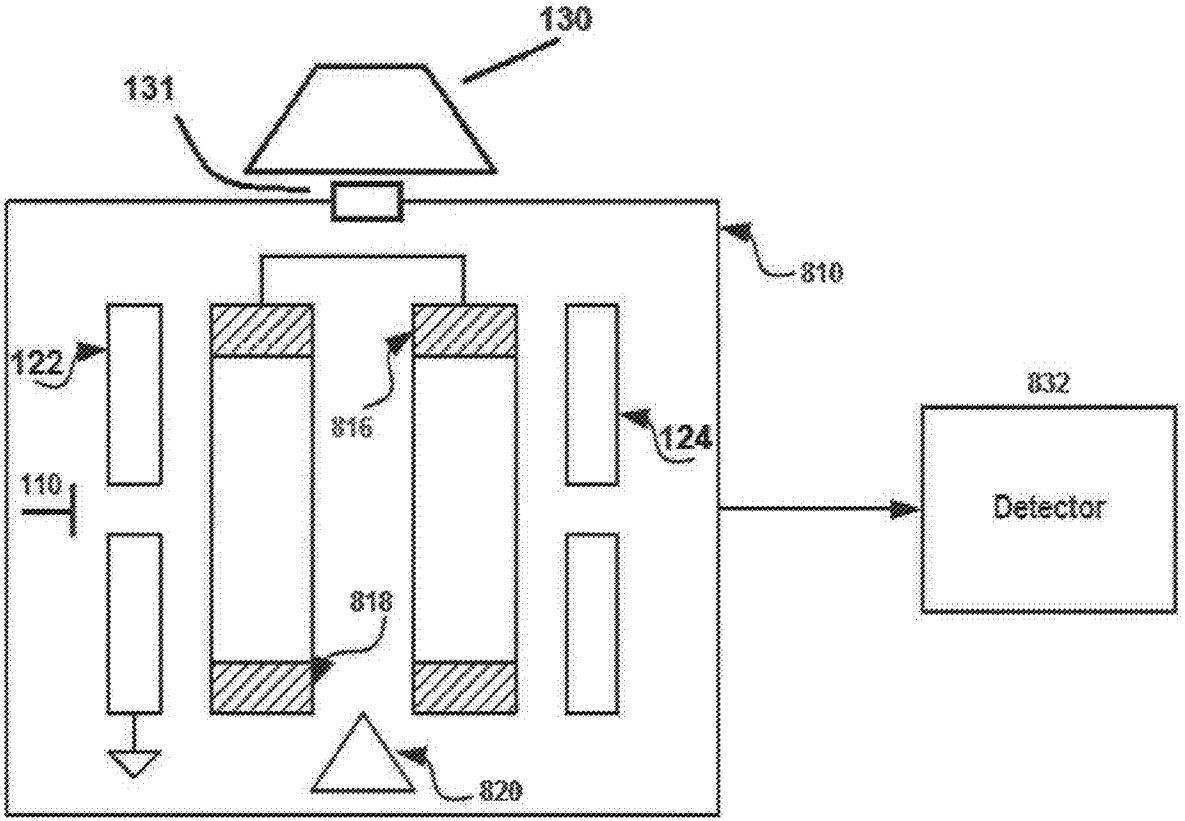
FIG. 8 shows schematic diagram of an exemplary mass analysis system consistent with disclosed embodiments.

FIG. 8 illustrates a schematic diagram of an exemplary mass analysis system, in accordance with some disclosed embodiments. The mass analysis system may include an ion trap apparatus 810 and a detector 832. Ion trap apparatus 810 may be similar to apparatus 100. For example, ion trap apparatus 810 may include end caps 122 and 124, ring electrodes 816 and 818, and injector 820, where injector 820 may be configured to inject ions into the trap at an off-axis angle that improves trapping efficiency. Detector 832 may include a single-point ion collector, such as a Faraday cup or electronic multiplier. In some embodiments, detector 832 may alternatively or additionally include a multipoint collector, such as an array or microchannel plate collector. Other suitable detectors may also be used. Ion trap apparatus may also include one or more devices for ionizing sample molecules that are injected into the ion trap volume. Electron multiplier 110 emits electrons into the ion trap volume via an aperture in endcap 122 as previously described. Photon source 130 shines an ionizing beam of photons through lens or window 131 and into the trap. The gap between ring electrodes 816 and 818 can be wider than the diameter of the aperture in endcap 124 and extend around the entire circumference of the trap; as such it can allow much more of the ionizing photon beam into the trap. This may improve ionization efficiency. When used in conjunction with off-axis ion injection via ion injector 820, considerable gains in sensitivity can be achieved.

The present disclosure provides a mass spectrometer providing both EI and PI. Therefore, the mass spectrometer may accurately detect the parent ion(s) of the compound(s) in a sample and the fragment ions that are formed from the parent molecule(s). This may allow a user to more easily detect and identify similar compounds having similar structures, but different molecular weights. It may also allow detection of compounds that are preferentially ionized using one or the other techniques. The ion trap may prevent electron emission during PI, which may also allow for more accurate detection by preventing unwanted fragmentation of sample compounds.

Additionally, the mass spectrometer of the present invention provides for both EI and PI within an ion trap. This may result in more accurate detection of the ions, and may reduce the size and complexity of the mass spectrometer. The ion trap may comprise end caps having different diameter sizes to prevent electron burn and ion accumulation. A pulsed light source may provide sufficient energy for photoionization within the ion trap. Additionally, the pulsed light source of the present disclosure may provide a signal that does not decay after a period of time, and therefore may continue to provide sufficient energy to ionize the sample.

It will be apparent to those skilled in the art that various modifications and variations can be made to the system of the present disclosure. Other embodiments of the system will be apparent to those skilled in the art from consideration of the specification and practice of the method and system disclosed herein. It is intended that the specification and examples be considered as exemplary only, with a true scope of the disclosure being indicated by the following claims and their equivalents.

What is claimed is:

1. A mass spectrometer, comprising:

an ion trap having an internal pressure substantially equal to a vacuum pressure and configured to trap an ionized sample, the ion trap including:

a first end cap, wherein the first end cap includes a first aperture, wherein the first aperture is configured to receive electrons from an axial direction for ionizing sample particles by electron ionization within the ion trap; and a center electrode, wherein the center electrode includes an opening having a larger open area than the first aperture, and wherein the opening is configured to receive photons from a radial direction for ionizing sample particles by photoionization within the ion trap, wherein the mass spectrometer is configured to alter an electrical signal applied to the ion trap to eject ionized sample particles from the ion trap based on mass-charge ratios of the ionized sample particles.

2. The mass spectrometer of claim 1, further including an electron source and a photon source.

3. The mass spectrometer of claim 2, wherein the photon source is a lamp.

4. The mass spectrometer of claim 2, wherein the photon source is a solid-state diode.

5. The mass spectrometer of claim 1, wherein the ion trap further includes a second end cap and wherein the center electrode is a ring electrode.

6. The mass spectrometer of claim 1, wherein the ion trap further includes a second end cap and the center electrode includes two ring electrodes having substantially the same size.

7. The mass spectrometer of claim 1, wherein the ion trap includes a coating sufficient to reduce electron emission during photoionization.

8. The mass spectrometer of claim 7, wherein the coating includes a conductive material having a work function higher than energy of the ionizing photons.

9. The mass spectrometer of claim 8, wherein the ion trap is configured to ionize the sample particles within a trapping field by both electron ionization and photoionization.

10. A method of ionizing a sample within an ion trap, comprising:

directing electrons into the ion trap along an axial direction of the ion trap through a first aperture on a first end cap of the ion trap, wherein the ion trap has an internal pressure substantially equal to a vacuum pressure;

fragmenting at least a portion of the sample into ionized sample particles with the electrons within the ion trap and ejecting the ionized sample particles from the ion trap according to mass-charge ratios of the ionized sample particles;

directing photons into the ion trap along a radial direction of the ion trap through an opening on a center electrode at a different time from the electrons, wherein the opening has a larger open area than the first aperture; and ionizing at least a portion of the sample into ionized sample particles with the photons within the ion trap and ejecting the ionized sample particles from the ion trap according to mass-charge ratios of the ionized sample particles, wherein the photons are provided as a series of pulses with a total energy sufficient to ionize the sample.

11. The method of claim 10, wherein the pulses are provided in vacuum in an ultraviolet wavelength range.

12. The method of claim 10, wherein the pulses comprise the same amplitude and duration.

13. The method of claim 12, wherein the pulses have a duration ranging from 2-50 ns.

14. The method of claim 10, wherein the electrons are provided from a filament.

15. The method of claim 10, wherein the photons are provided from a laser diode.

16. The method of claim 10, wherein the photons are provided from a lamp.

17. The method of claim 10, wherein the pulses include a series of overlapping pulses.

18. The method of claim 17, wherein the photons are provided from more than one laser diode.

19. The method of claim 10, wherein the ion trap is a split electrode quadrupole trap.

20. A mass spectrometer comprising:

an ion trap having an internal pressure substantially equal to a vacuum pressure and configured to provide both electron ionization and photoionization within the ion trap, wherein the ion trap includes:

a first end cap having a first aperture configured to receive electrons from an axial direction for electron ionization; and a center electrode, wherein the center electrode includes an opening having a larger open area than the first aperture and wherein the opening is configured to receive photons from a radial direction for photoionization;

an electron source configured to provide electrons to the ion trap;

a photon source configured to provide photons to the ion trap; and an ion detector coupled to the ion trap, wherein the ion detector is configured to detect sample ions ejected from the ion trap and to detect sample ions ionized by at least one of the electron source or the photon source, wherein the mass spectrometer is configured to alter an electrical signal applied to the ion trap to eject the sample ions from the ion trap based on mass-charge ratios of the sample ions.

21. The mass spectrometer of claim 20, wherein the photon source includes one or more laser diodes configured to provide a series of photon pulses to the ion trap.

22. The mass spectrometer of claim 20, wherein the ion trap includes a coating configured to reduce electron emission during photoionization.

23. The mass spectrometer of claim 20, wherein the ion trap is a split electrode quadrupole trap.

* * * * *